US010662017B2

(12) United States Patent
Johnson et al.

(10) Patent No.: US 10,662,017 B2
(45) Date of Patent: May 26, 2020

(54) MEDIA OUTPUT SYSTEM

(71) Applicant: Hewlett-Packard Development Company, L.P., Houston, TX (US)

(72) Inventors: Bruce G Johnson, LaCenter, WA (US); Al Olson, Vancouver, WA (US); Steve O Rasmussen, Vancouver, WA (US); Elliott Downing, Vancouver, WA (US); Jonathan Cha Spafford, Vancouver, WA (US); Michael J Wilmink, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/759,581

(22) PCT Filed: Dec. 9, 2015

(86) PCT No.: PCT/US2015/064663
§ 371 (c)(1),
(2) Date: Mar. 13, 2018

(87) PCT Pub. No.: WO2017/099743
PCT Pub. Date: Jun. 15, 2017

(65) Prior Publication Data

US 2018/0251330 A1 Sep. 6, 2018

(51) Int. Cl.
*B65H 31/02* (2006.01)
*B65H 31/20* (2006.01)
(Continued)

(52) U.S. Cl.
CPC ..... *B65H 31/02* (2013.01); *B41J 29/02* (2013.01); *B65H 31/20* (2013.01);
(Continued)

(58) Field of Classification Search
CPC .... B65H 31/3063; B65H 31/02; B65H 31/20; B65H 31/34; B65H 2405/1161; B65H 2405/351; B65H 2405/1118
See application file for complete search history.

(56) References Cited

U.S. PATENT DOCUMENTS 5,791,642 A 8/1998 Sawano et al.
5,806,842 A 9/1998 Steinhilber et al.
(Continued)

FOREIGN PATENT DOCUMENTS

CN 102248811 11/2011
CN 104743396 7/2015
(Continued)

OTHER PUBLICATIONS

Canon. Canon imagePRESS C7011/VP Digital Color Press ~ 2 pages ~ date unknown.

*Primary Examiner* — Patrick Cicchino
(74) *Attorney, Agent, or Firm* — Fabian VanCott

(57) ABSTRACT

A printing device includes, in one example, a media output system including a mezzanine level including a plurality of media support members, the mezzanine level being intermediate to a floor level and a media output level; wherein the plurality of media support members move orthogonally relative to a print media path so that a number of finishing processes may be performed on print media accumulated on the number of media support members.

18 Claims, 9 Drawing Sheets

(51) Int. Cl.

| | |
|---|---|
| ***B65H 31/34*** | (2006.01) |
| ***B41J 29/02*** | (2006.01) |
| ***B65H 31/30*** | (2006.01) |
| *B27F 7/17* | (2006.01) |
| *B26F 1/02* | (2006.01) |
| *B41J 29/38* | (2006.01) |
| *B26F 1/00* | (2006.01) |

(52) U.S. Cl.
CPC ..... *B65H 31/3018* (2013.01); *B65H 31/3063* (2013.01); *B65H 31/34* (2013.01); *B26F 1/0092* (2013.01); *B26F 1/02* (2013.01); *B27F 7/17* (2013.01); *B41J 29/38* (2013.01); *B65H 2301/4212* (2013.01); *B65H 2301/4213* (2013.01); *B65H 2403/41* (2013.01); *B65H 2404/693* (2013.01); *B65H 2405/112* (2013.01); *B65H 2405/114* (2013.01); *B65H 2405/1116* (2013.01); *B65H 2405/1118* (2013.01); *B65H 2405/351* (2013.01); *B65H 2408/121* (2013.01); *B65H 2511/232* (2013.01); *B65H 2513/104* (2013.01); *B65H 2601/22* (2013.01); *B65H 2701/1829* (2013.01); *B65H 2701/18292* (2013.01); *B65H 2801/27* (2013.01)

(56) References Cited

U.S. PATENT DOCUMENTS

| | | | | |
|---|---|---|---|---|
| 6,231,039 | B1 * | 5/2001 | Chung | B42C 1/12 270/58.01 |
| 6,550,763 | B2 * | 4/2003 | Gordon | B65H 31/26 271/189 |
| 7,310,495 | B2 | 12/2007 | Kayama et al. | |
| 7,448,615 | B2 * | 11/2008 | Takamura | B42C 1/12 270/58.11 |
| 7,744,210 | B2 | 6/2010 | Verhoest et al. | |
| 7,823,880 | B2 | 11/2010 | Coenen et al. | |
| 7,934,825 | B2 | 5/2011 | Lang | |
| 8,152,264 | B2 | 4/2012 | Takahashi | |
| 8,540,229 | B2 * | 9/2013 | Tsuji | G03G 15/6541 270/58.12 |
| 8,600,288 | B2 | 12/2013 | Shiraki et al. | |
| 9,090,425 | B2 * | 7/2015 | Kimura | G03G 15/6541 |
| 9,199,814 | B2 * | 12/2015 | Imai | B65H 7/20 |
| 9,415,967 | B2 * | 8/2016 | Wakide | H04N 1/0066 |
| 9,708,141 | B2 * | 7/2017 | Kishi | B65H 29/52 |
| 9,890,010 | B2 * | 2/2018 | Okamoto | H05K 999/99 |
| 9,933,743 | B2 * | 4/2018 | Takahashi | G03G 15/6538 |
| 2004/0084827 | A1 | 5/2004 | Takamura | |
| 2006/0066026 | A1 * | 3/2006 | Terao | B65H 29/34 270/58.11 |
| 2007/0182082 | A1 * | 8/2007 | Asami | B65H 37/04 270/32 |
| 2012/0093559 | A1 | 4/2012 | Vanheuverzwijn | |
| 2015/0175377 | A1 * | 6/2015 | Shelhart | B65H 31/30 412/1 |
| 2015/0183606 | A1 * | 7/2015 | Nishi | B65H 31/02 271/234 |
| 2015/0309463 | A1 * | 10/2015 | Masunari | G03G 15/6544 412/16 |

FOREIGN PATENT DOCUMENTS

| | | |
|---|---|---|
| JP | 3474048 | 7/1997 |
| JP | 2004142868 | 5/2004 |
| JP | 2015-124069 | 7/2015 |

* cited by examiner

MEDIA OUTPUT SYSTEM

BACKGROUND

Printing devices may include an output tray where sheets of print media are accumulated. Often, additional finishing processes may be conducted on an accumulated stack of print media within the output tray including stapling and hole punching.

BRIEF DESCRIPTION OF THE DRAWINGS

The accompanying drawings illustrate various examples of the principles described herein and are a part of the specification. The illustrated examples are given merely for illustration, and do not limit the scope of the claims.

Throughout the drawings, identical reference numbers designate similar, but not necessarily identical, elements.

DETAILED DESCRIPTION

Figure 1A:
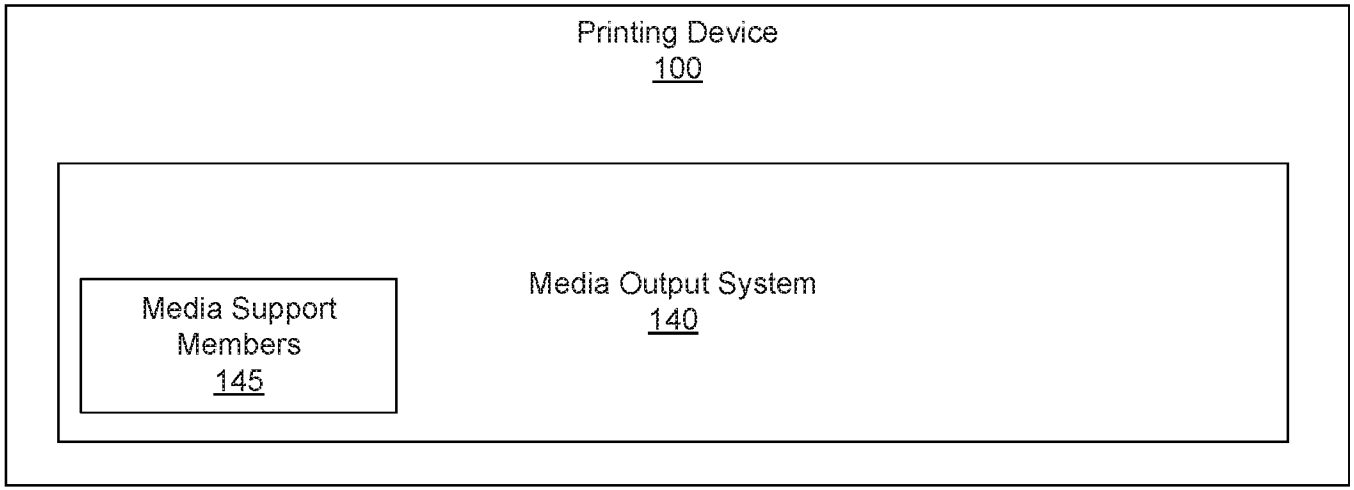
FIG. 1A is a block diagram of a printing device according to an example of the principles described herein.

As mentioned above, printing devices may include a number of output trays where print media is allowed to accumulate. In some examples, the accumulation of the print media is done so that later finishing processes such as stapling, hole punching, binding, saddle stitching, and folding may be conducted on the entire stack of accumulated print media.

In preparation for these finishing processes, the individual sheets of print media are stacked and aligned. The alignment is done such that, in one example, the entire stack of print media may be stapled together. The stapled final product is presented to an end user looking professionally assembled. A misalignment of the sheets during a stapling process would not result in a professionally appealing product. Where the sheets of print media are to have holes punched through them, any misalignment of the sheets may result in a poorly looking final product as well as a poorly functioning product. Misalignment of these sheets in this example may prevent the stack from being assembled into, for example, a binder.

In some printing devices such as inkjet printing devices, alignment of the individual sheets of print media may be difficult to achieve. This may be especially true immediately after the printed sheets of print media have exited the printing device and have begun to accumulate in the output tray. Printing fluid from the inkjets may not have dried sufficiently to provide, for example, a relatively friction-free surface between the accumulated sheets of print media. In this case, any accumulated sheets of print media would not align properly due to the sheets not being able to be pushed into alignment using, for example, tapper bars. Indeed, as sheets of print media are being registered within the output tray, it is possible that the position of a previous sheet of print media can be changed as subsequent sheets of print media accumulate in the output tray.

Page curl may also result when printing fluid has been soaked into the fibers of the print media. This resulting curl may prevent alignment of the individual sheets. Still further, reduced page stiffness due to the printing fluid soaking into the printed media may further cause misalignment of the sheets of print media due to the inability of the print media to be properly stacked. Should the print media be allowed to accumulate in the tray, with or without tapper bars, the reduced stiffness of the print media may cause it to bunch up.

The present specification describes a printing device including, in one example, a media output system including a mezzanine level including a plurality of media support members, the mezzanine level being intermediate to a floor level and a media output level; wherein the plurality of media support members move orthogonally relative to a print media path so that a number of finishing processes may be performed on print media accumulated on the number of media support members.

The present specification also describes a method of finishing a number of sheets of print media, including, in one example, accumulating a number of sheets of print media onto a plurality of media support members within a media output system and moving the plurality of media support members in a direction orthogonal to the direction of a media feed path, wherein a first media support member of the plurality of media support members advances relatively faster than a second media support member of the plurality of media support members.

The present specification further describes a media output system that includes, in one example a plurality of media support members to receive a number of sheets of print media from a printing device, a print finishing device to conduct finishing processes on the number of sheets of print media, wherein the plurality of media support members transport the number of sheets of print media towards the finishing device with each of the plurality of media support members moving at different speeds relative to each other.

As used in the present specification and in the appended claims, the terms "media" or "print media" is meant to be understood as any surface that may receive an image thereon. In an example, a printing device may apply the image to the print media. In an example, the image may be a three-dimensional image formed by application of a number of layers of printing fluid.

Additionally, as used in the present specification and in the appended claims, the term "a number of" or similar language is meant to be understood broadly as any positive number including 1 to infinity.

In the following description, for purposes of explanation, numerous specific details are set forth in order to provide a thorough understanding of the present systems and methods. The present apparatus, systems and methods may be practiced without these specific details. Reference in the specification to "an example" or similar language means that a particular feature, structure, or characteristic described in connection with that example is included as described, but may not be included in other examples.

Figure 1B:
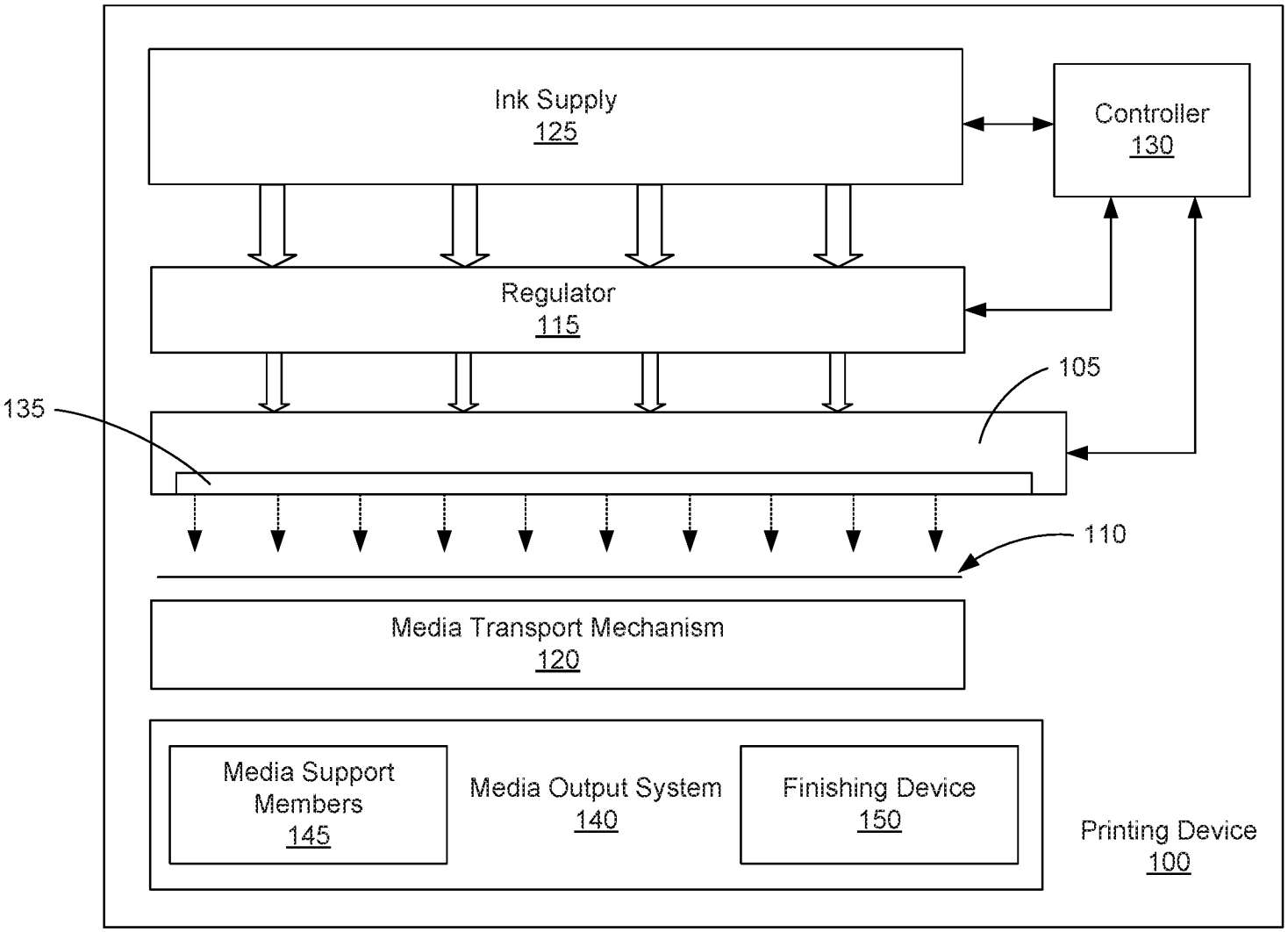
FIG. 1B is a block diagram of a printing device according to an example of the principles described herein.

Turning now to the figures, FIGS. 1A and 1 B are block diagrams of a printing device (100) according to a number of examples of the principles described herein. FIG. 1A shows a printing device (100) including a media output system (140) that includes a number of media support members (145) to, in one example, move in a direction orthogonal to a direction of a media feed path. FIG. 1B depicts the printing device (100) including the media output system (140) and the number of media support members (145) as well as a number of other devices that, in one example, may be included in the printing device (100) to provide further functionality. The printing device (100) may be any type of device that reproduces an image onto a sheet of print media. In one example, the printing device (100) may be an inkjet printing device, laser printing device, a toner-based printing device, a solid printing fluid printing device, a dye-sublimation printing device, among others. Although the present printing device (100) is described herein as an inkjet printing device, any type of printing device may be used in connection with the described systems, devices, and methods described herein. Consequently, an inkjet printing device (100) as described in connection with the present specification is meant to be understood as an example and is not meant to be limiting.

The printing device (100) may include a print bar (105), a printing fluid supply, (125), a printing fluid supply regulator (115), a media transport mechanism (120), a media output system (140), and a controller (130). The printing fluid supply (125) may provide printing fluid or another type of ejectable fluid to the printing fluid supply regulator (115). The printing fluid supply regulator (115) may regulate an amount of printing fluid or other ejectable fluid provided to the print bar (105).

The print bar (105) may include a number of printheads (135) that receive the supply of ejectable fluid and eject the ejectable fluid onto a sheet of print media (110). In the example where the printing device (100) is an inkjet printing device, the ejectable fluid may penetrate the fibers of the print media (110) thereby producing an image on the print media (110). As mentioned above, un-dried or partially dried ejectable fluid on the print media (110) causes the print media (110) to be distorted from curl or cockle, reduces the stiffness of the print media (110), and increases the surface roughness on the print media (110) causing an increase in the coefficient of friction of the print media. These changes to the physical properties of the print media (110) prevents any given sheet of print media (110) from being stacked or accumulated together such that each sheet is aligned with the others in an x- and y-direction. The media transport mechanism (120) may physically place these sheets in position to be accumulated, but there may not be a way to maintain a position of any given sheet once it is released from the media transport mechanism (120). Still further, the media transport mechanism (120) may not place each and every printed sheet of print media (110) in the same location every instance and may have a variable degree of accuracy.

As will be described in more detail below, the media output system (140) of the present specification receives the printed print media (110) via the media transport mechanism (120). In one example, the media output system (140) may be an output tray coupled to the printing device (100) including those devices within the system described herein. The media output system (140) receives the print media onto a plurality of media support members (145) on a mezzanine level within the media output system (140). The mezzanine level (291, FIG. 2) may be intermediate to a media transport level (290, FIG. 2) including the media transport mechanism (120) and an output level (292, FIG. 2) including a floor of the media output system (140).

The media output system (140) may further include a finishing device (150) to perform a number of finishing procedures on a stacked number of sheets of print media (110). These finishing procedures may include stapling, hole punching, embossing, binding, among others, or combinations thereof. Other types of finishing procedures may be conducted using a number of other types of finishing devices (150) and the present specification contemplates the use of these other types of finishing devices (150).

The printing device (100) may further include a controller (130) to control each of the other devices associated with the printing device (100). In one example, the controller (130) may receive from, for example, a networked computing device, instructions to print and characteristics regarding a print job including the images to be printed on the print media (110) and the size and type of print media (110) to be printed. These instructions may be used by the controller (130) to direct the printing of a sheet of print media (110), the transportation of the print media (110), the accumulation of the print media (110) on the plurality of media support members (145), and the initiation of the finishing procedures described above.

As will be discussed in more detail below, the controller may receive data describing the type and size of the print media (110) and adjust the position of the media support members (145) based on the type and size of the print media (110). As will be described in more detail below, in one example, the controller (130) controls the movement and speed of the media support members (145) via activation of a number of motors associated with the media support members (145).

Figure 3:
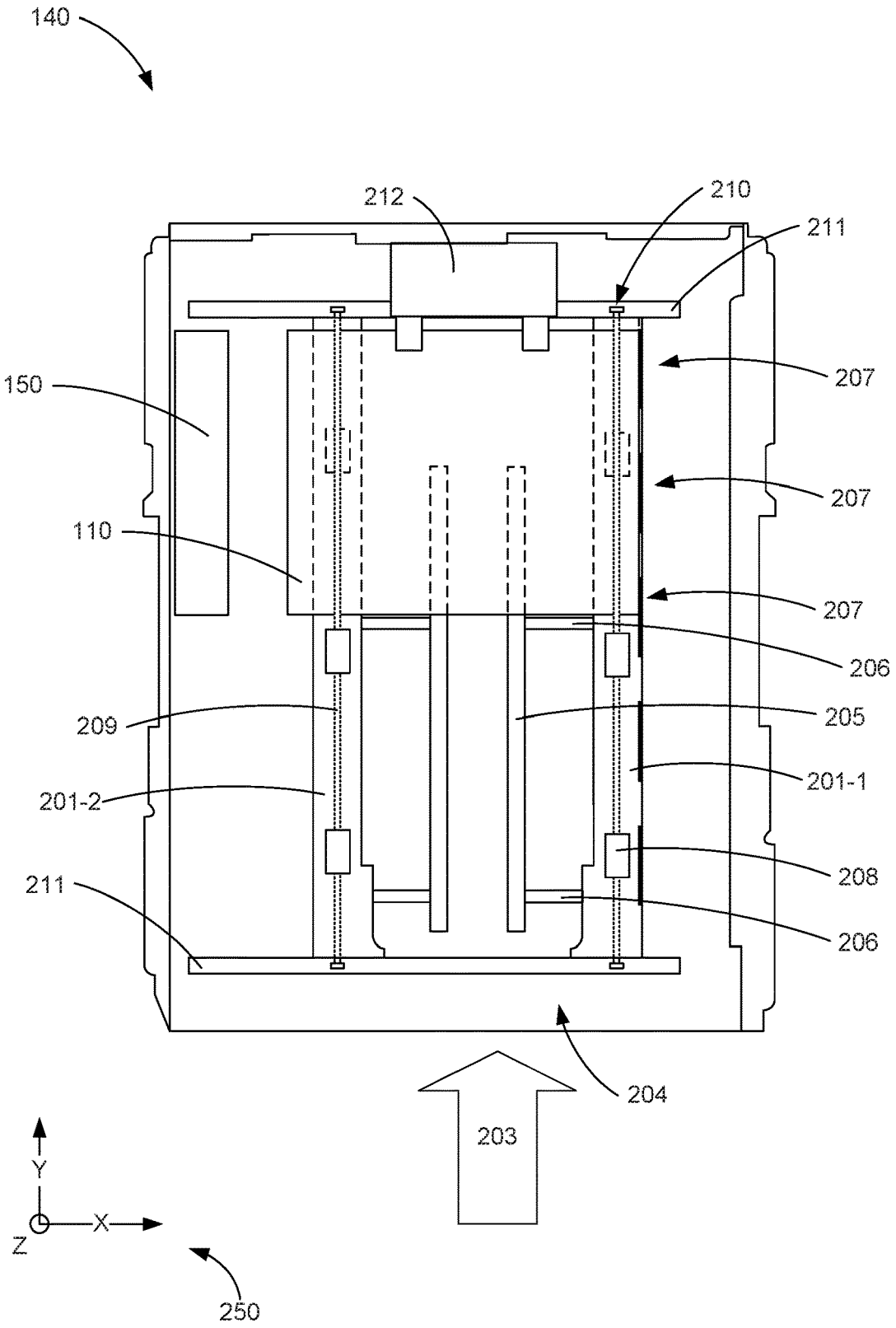
FIG. 3 is a top view of a media output system of the printing device of FIG. 1B according to an example of the principles described herein.

FIG. 3 is a top view of a media output system (140) of the printing device (FIG. 1, 100) of FIG. 1 according to one example of the principles described herein. As an indication of reference, a three-dimensional Cartesian coordinate indicator (250) is shown in FIG. 3. Throughout the drawings, the three-dimensional Cartesian coordinate indicator is provided to orient the reader as to directions of movement and forces placed on the elements of the mezzanine support member (201). Throughout the figures, a circle located at the origin of the coordinate indicator indicates that the positive direction is moving or coming out of the page toward the reader. Conversely, a square indicates that the negative direction is moving or coming out of the page toward the reader.

As mentioned above, the media output system (140) may include a plurality of media support members (201). In the example shown in FIG. 3, the number of media support members (201) is two. Although FIG. 3 shows two media support members, any plurality of media support members (201) greater than two may be used and the present specification contemplates the use of any number of media support members (201) exceeding two. In FIG. 3, the print media (110) is received into the media output system (140) from the bottom of the figure as indicated by a print media path arrow (203). The media transport mechanism (FIG. 1, 120) may advance the print media (110) onto the media support members (201). In one example, the media transport mechanism (FIG. 1, 120) may include, among other devices, a series of clamps and pulleys to receive the print media (110) from the output of the printing device (FIG. 1, 100) and place it onto the plurality of media support members (145).

Each of the media support members (145) includes a number of articulating extension bars (205) and a number of extension arms (206). The extension arms (306) and articulating extension bars (205) may provide additional support to print media (110) as it accumulates on the mezzanine support members (201). In one example, articulation of the extension bars (205) out from the media support members (201) may be accomplished through movement of the media support members (201) via a number of gears. In another example, articulation of the extension bars (205) out from the media support members (201) may be accomplished through use of an independently driven motor. The extension bars (205) may help support the print media (110) on the mezzanine level along with the media support members (201). This may prevent the print media (110) from sagging between the media support members (201) as the print media (110) is accumulated on the media support members (201). Additionally, preventing sagging of the print media (110) may also prevent a permanent or semi-permanent deformation of the print media as the print media (110) is being accumulated on the media support members (201). The controller (FIG. 1, 130) may direct the articulation of the extension bars (205) out from the media support members (201) based on, for example, the orientation, size, and type of print media (110) being used for a print job.

In order to perform a number of finishing procedures, the media support members (201) may be moved in a direction orthogonal to the print media path (arrow 203) such that an accumulated stack of print media (110) may be advanced towards a finishing device (150). As described above, the finishing device (150) may be a stapler, a hole puncher, an embosser, or other type of finishing device used to perform a number of finishing processes on the accumulated sheets of print media (110). In one example, the finishing device (150) may include any number of devices that perform the above described functions. In another example, the finishing device (150) may be a combination of the finishing devices as described above, with at least one of the aggregated finishing tools performing a finishing process on the accumulated sheets of print media (110).

At least one of the media support members (201) may include a number of x-registration members (207). The x-registration members (207) may be a surface against which each of the sheets of print media (110) lie alongside when accumulated on the media support members (201). This causes each of the sheets of print media (110) to be registered in the x-direction as indicated by the three-dimensional Cartesian coordinate indicator (250). When the media support members (201) move orthogonal to the print media path (arrow 203) in order to engage an accumulated stack of print media (110) towards a finishing device (150), the x-registration members (207) prevent the accumulated stack of print media (110) from misaligning in the x-direction relative to each other.

The media output system (140) may further include a number of y-registration members. In one example, the y-registration members may be coupled to each of media support members (201-1, 201-2) and may move with the movement of the media support members (201-1, 201-2). In another example, the y-registration members may be coupled to another part of the media output system (140) separate from the media support members (201-1, 201-2). Similar to the x-registration members (207), the y-registration members may be a surface against which each of the sheets of print media (110) lie alongside when accumulated on the media support members (201). This causes each of the sheets of print media (110) to be registered in the y-direction as indicated by the three-dimensional Cartesian coordinate indicator (250). When the media support members (201) move orthogonal to the print media path (arrow 203) in order to engage an accumulated stack of print media (110) towards a finishing device (150), the y-registration members prevent the accumulated stack of print media (110) from misaligning in the y-direction relative to each other.

At least one media support member (120) may include a number of friction surfaces or pads (208). The friction surfaces (208) may create friction between, at least, a first sheet of print media (110) placed on the media support members (201-1, 201-2). The friction created by the friction surfaces (208) may exceed the coefficient of friction that the surface of the media support members (201-1, 201-2) may create with a sheet of print media (110). When an initial sheet of print media (110) is received on the media support members (201-1, 201-2), the added friction created between the initial sheet of print media (110) and the friction surfaces (208) stops the print media (110) from sliding on the media support member (201-1, 201-2) interface and improves registration of the print media (110). In one example, the friction surfaces (208) may include a number of raised ribs that run orthogonally relative to a print media path. These raised ribs may cause a sheet of print media to be registered in x-axis the direction orthogonally relative to a print media path with relatively minimal interaction with the friction surfaces (208). These raised ribs may further minimize movement by the sheet of print media when the sheet of print media is registered in a direction parallel to the media feed path. In one example, the raised ribs of the friction surfaces (208) provide friction between the first of many sheets of print media (110) to be accumulated onto the media support members (201-1, 201-2).

The media support members (201) as shown in FIG. 3 are located in a "home" position away from the finishing device (150) and in the print media feed path (203). As described above, the media support members (201) are moved toward the finishing device (150) to cause a number of finishing processes to be completed on the print media (110). When the media support members (201) are moved toward the finishing device (150), the movement of each of the media support members (201) is independent of each other. In one example, the media support member having the number of x-registration members (207) coupled thereto (referred herein as the "front" media support member) moves relatively faster than the media support member closest to the finishing device (150) (referred herein as the "back" media support member). Because the speed of the front media support member (201-1) is faster than the back support member (201-2), the accumulated sheets of print media (110) on the media support members (201-1, 201-2) stay registered against the x-registration members (207) and aligned with each other.

After the finishing device (150) has completed a number of finishing processes, the media support members (201-1, 201-2) may be moved back to the home position in the media feed path. To prevent misalignment of the print media (110) in the x-direction and to keep each sheet of print media (110) against the x-registration members, each of the media support members (201-1, 201-2) are, again, moved at different speeds relative to each other. In one example, the back media support member (201-2) may be moved faster than the front media support member (201-1). This again causes each of the sheets of print media (110) to remain registered against the x-registration members as each of the media support members (201-1, 201-2) move to the home position.

In one example, an initial speed of either of the media support members (201-1, 201-2) may be greater than the other but may then be allowed to match the other media support member (201-1, 201-2) after a certain distance. For example, where the front media support member (201-1) is to move relatively faster than the back support member (201-2), the initial speed of the front media support member (201-1) may be faster than that of the back support member (201-2). However, as the two media support member (201-1, 201-2) progress towards the finishing device (150), the front media support member (201-1) may be allowed to accelerate down to match the speed of the back media support member (201-2). The opposite is true when the media support member (201-1, 201-2) are returned to the home position. In this case, it is the back media support member (201-2) that is allowed to be initially faster than the front media support member (201-1) but as the movement progresses is then allowed to match the relatively slower speed of the front media support member (201-1).

Independent movement of each of the media support members (201-1, 201-2) may be accomplished by a motor associated with each of the media support members (201-1, 201-2). Each motor may drive a shaft (209) that runs through the entire length of the each of the media support members (201-1, 201-2). Each end of each of the shafts (209) terminates in an end gear (210). Each end gear (210) includes a number of teeth that mesh with a number of teeth defined in a gear rack (211) running orthogonal to each of the media support members (201-1, 201-2). As each motor drives the shafts (209) of each of the media support members (201-1, 201-2), for example, each of the entire media support members (201-1, 201-2) may move orthogonal to the print media path (203) as described above.

Figure 4:
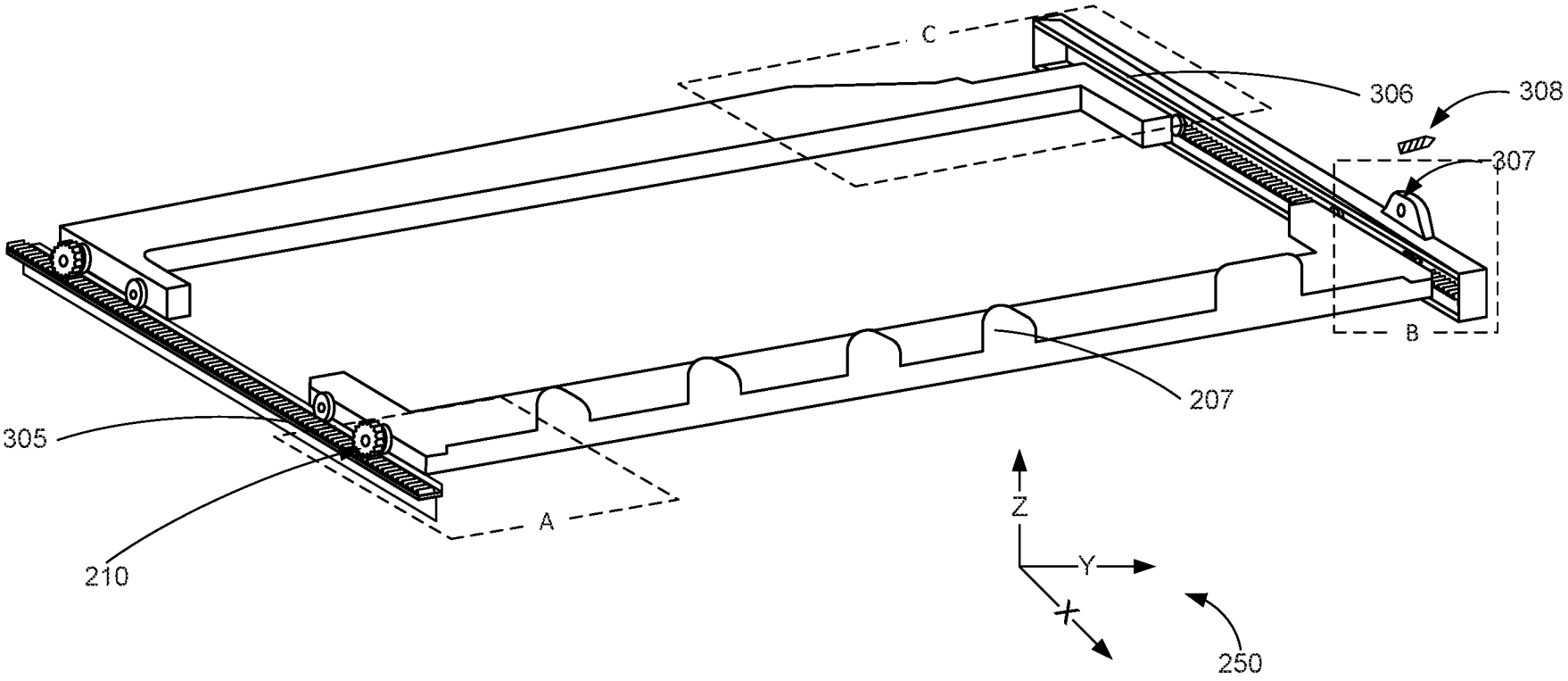
FIG. 4 is a perspective view of the media support members and gear racks of FIG. 2 according to an example of the principles described herein.

FIG. 4 is a perspective view of the media support members (201-1, 201-2) and gear racks (211) of FIG. 3 according to one example of the principles described herein. In order to achieve registration of a sheet of print media (FIG. 2, 110) in both the x- and y-directions, the positioning of the media support members (201-1, 201-2) to the gear racks (211) are made to form a 90° angle between each of them. This way, at least two sides of a print media (FIG. 2, 110) may lie flush with the x- and y-registration members at all times. During, for example, a fabrication process of the printing device (100) incorporating the media output system (140) described herein, a front gear rack (305) is affixed to an interior surface of the media output system (140). Each of the media support members (201-1, 201-2) are then assembled to the front gear rack (305) and a rear gear rack (306) is assembled to the media support members (201-1, 201-2). In another example, both the front (305) and rear gear racks (306) are assembled in the printing device (FIG. 1, 100) and the media support members (201-1, 201-2) are then assembled to the front (305) and rear gear racks (306).

The rear gear rack (306) further includes a set hole (307) that has been threaded to receive a set screw (308). During assembly at the factory, for example, the media support members (201-1, 201-2) are to be squared up with the rear gear rack (306). Squaring the media support members (201-1, 201-2) with, at least, the rear gear rack (306) is done by threading the set screw (308) through the set hole (307). The set screw (308) contacts a portion of the media output system (140) setting the rear gear rack (306) in position for use by a user. Securing the rear gear rack (306) to the media output system (140) ensures x- and y-registration of a sheet of print media (FIG. 2, 110) during use of the media output system (140) by an end user.

Figure 5:
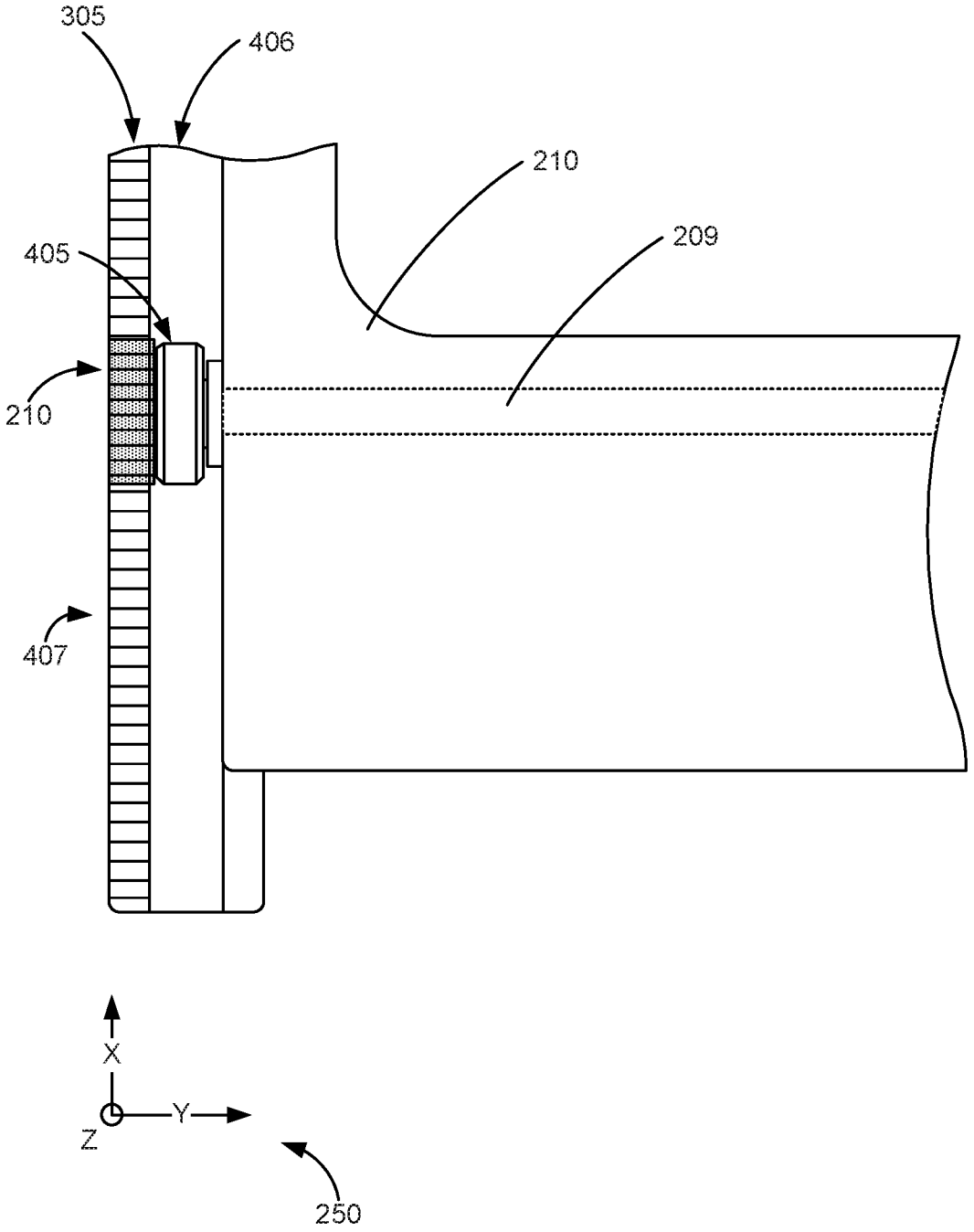
FIG. 5 is a detailed view of Box A of FIG. 3 showing a top view of the front gear rack and media support member interface shown in FIG. 3 according to an example of the principles described herein.
Figure 6:
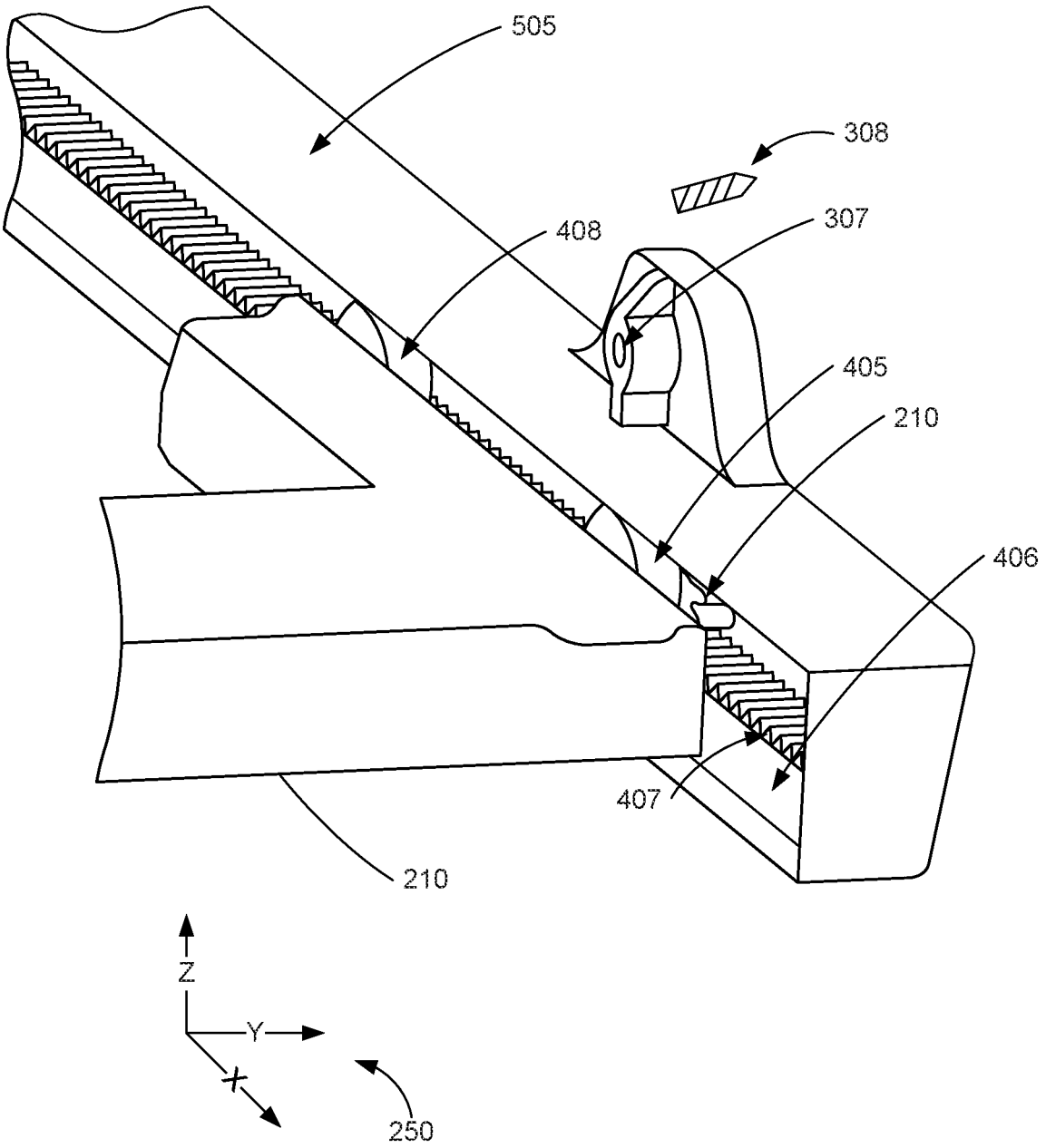
FIG. 6 is a detailed view of Box B of FIG. 3 showing a perspective view of the media support member and rear gear rack of FIG. 3 according to an example of the principles described herein.
Figure 7:
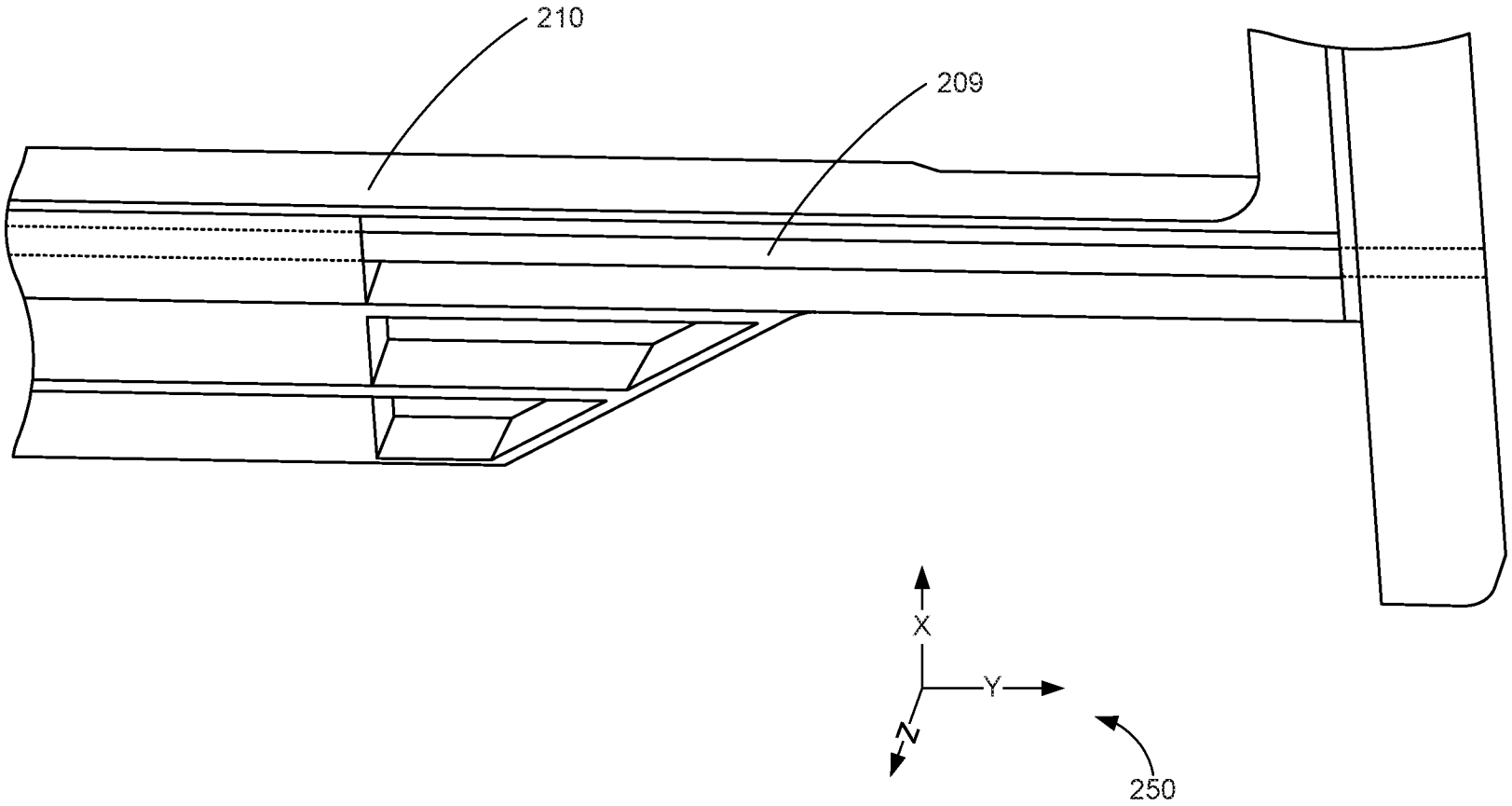
FIG. 7 is a detailed view of Box C of FIG. 3, showing an underside perspective view of the media support member and rear gear rack interface according to an example of the principles described herein.

FIG. 4 further includes a number of callout boxes (A, B, C) that correlate with FIGS. 5, 6 and 7 respectively. Each of FIGS. 5, 6 and 7 show relatively more detailed views of portions of the media support members (201-1, 201-2) and gear racks (305, 306). FIG. 5 is a detailed view of Box A of FIG. 4 showing a top view of the front gear rack (305) and media support member (201-1, 201-2) interface shown in FIG. 4 according to one example of the principles described herein. FIG. 6 is a detailed view of Box B of FIG. 4 showing a perspective view of the media support member (201-1, 201-2) and rear gear rack (306) of FIG. 4 according to one example of the principles described herein. FIG. 7 is a detailed view of Box C of FIG. 4, showing an underside perspective view of the media support member (201-1, 201-2) and rear gear rack (306) interface according to one example of the principles described herein.

Turning now to FIG. 5, the shaft (209) is shown running through the media support member (201-1, 201-2) and terminating at an end gear (210). In one example, the shaft (209) may further include a wheel (405) coupled next to the end gear (210) that engages a smooth portion (406) of the front gear rack (305) that runs parallel to the gear rack teeth (407) defined in the front (and rear) gear rack (305, 306). The wheel (405) may provide the shaft (209) and end gear (210) as well as the media support member (201-1, 201-2) with additional mechanical support.

As described above, each of the media support members (201-1, 201-2) are independently driven by, for example, a motor mechanically coupled to the shaft (209). The motor may be directly mechanically coupled to the shaft (209) or may be or may impart a force on another device such as a gear to cause the media support member (201-1, 201-2) to move. Control of the movement of the media support member (201-1, 201-2) is accomplished via the controller (FIG. 1, 130) of the printing device (FIG. 1, 100) as described above. The movement of the media support member (201-1, 201-2) may be dependent on the finishing processes to be conducted on a sheet or sheets of print media (FIG. 2, 110) as well as the size, orientation, and type of print media (FIG. 2, 110) to receive the printed image.

As mentioned, the front and back gear racks (305, 306) may have defined therein a number of gear rack teeth (407). These teeth (407) mesh with those teeth of the end gear (210) so that radial movement of the end gear (210) results in progression of the entire media support member (201-1, 201-2) in the x-direction. Alignment of the front gear rack (305) with the rear gear rack (306) provides for alignment of each of the gear rack teeth (407) in the x-direction. The end gears (210) on both ends of both shafts (209) are precision clocked relative to each other. The alignment of the teeth in the front gear rack (305) and rear gear rack (306) ensures that the media support members' (201-1, 201-2) alignment to the y-registration wall will be maintained as the media support members (201-1, 201-2) travel. Additionally, this configuration prevents drift of the media support members (201-1, 201-2) over life of the printing device (FIG. 1, 100). Consequently, as the media support members (201-1, 201-2) progress along the front gear rack (305) and rear gear rack (306), the media support members (201-1, 201-2) remain perpendicular to the front gear rack (305) and rear gear rack (306) at all times. Consequently, this maintains each sheet of print media (FIG. 2, 110) at an x- and y-registration as described above.

Turning now to FIG. 6, a relatively more detailed view of Box B of FIG. 4 is shown showing a perspective view of the media support member (201-1, 201-2) and front gear rack (305) of FIG. 3 according to one example of the principles described herein. In this example, the rear gear rack (306) also includes a wheel (405) coupled next to the end gear (210) that engages a smooth portion (406) of the rear gear rack (306). The wheel (405) may provide the shaft (209) and end gear (210) as well as the media support member (201-1, 201-2) with additional mechanical support. In one example, a second wheel (408) may be further coupled to a portion of the media support member (210) to add stability to the media support member (210).

In the example shown in FIG. 6, the rear gear rack (306) may have a shelf (505) that covers a portion of the wheel (405) and end gear (210). In this example, the shelf may prevent contaminants, other devices in the printing device (FIG. 1, 100), and/or sheets for print media (FIG. 1, 110) from contacting the end gear (210) and/or gear rack teeth (407).

Turning now to FIG. 7, an underside of the back support member (201-2) showing the positioning of the shaft (209) therein. Although FIG. 7 shows a back support member (201-2) similar features may be included in the front media support member (201-1). The shaft (209) may run the entire length of the media support members (201-1, 201-2) and may provide support to each of the media support member (201-1, 201-2) as it progresses orthogonal relative to a print media path.

As describe above, the movement of each of the media support members (201-1, 201-2) and finishing devices (150) is dependent on those instructions received from the controller (FIG. 1, 130). When a first sheet of pre-processed print media (FIG. 2, 110) by the controller (FIG. 1, 130), the controller (FIG. 1, 130) provides a number of commands based on the specific attributes of the print job. These attributes include, but, are not limited to: sheet size, sheet orientation, stapling or not, staple location, hold punching or not, embossing or not, and media type. The controller (FIG. 1, 130) uses this information to position the media support member (201-1, 201-2) in the correct position in advance of the arrival of the first sheet of print media (FIG. 2, 110) as well as define specific finishing operations described above. In one example, as the first sheet and all subsequent sheets of print media (FIG. 2, 110) arrive at the output system (FIG. 2, 140), the location of a leading edge of each sheet of print media (FIG. 2, 110) may be measured. The location data associated with each sheet of print media (FIG. 2, 110) may then be used to precision position the print media (FIG. 2, 110) in the x-registration and against the x-registration walls (FIG. 3, 207) on the front media support member (201-1) as the print media (FIG. 2, 110) is pulled into the output system (FIG. 2, 140) by the media transport mechanism (120). Due to a calibration process between the incoming edge sensor and the front media support member (201-1) x-registration walls (FIG. 3, 207), each sheet of print media (FIG. 2, 110) is accurately positioned against the x-registration walls (FIG. 3, 207). This process is repeated for each sheet of print media (FIG. 2, 110) until the entire print job is complete.

Figure 8:
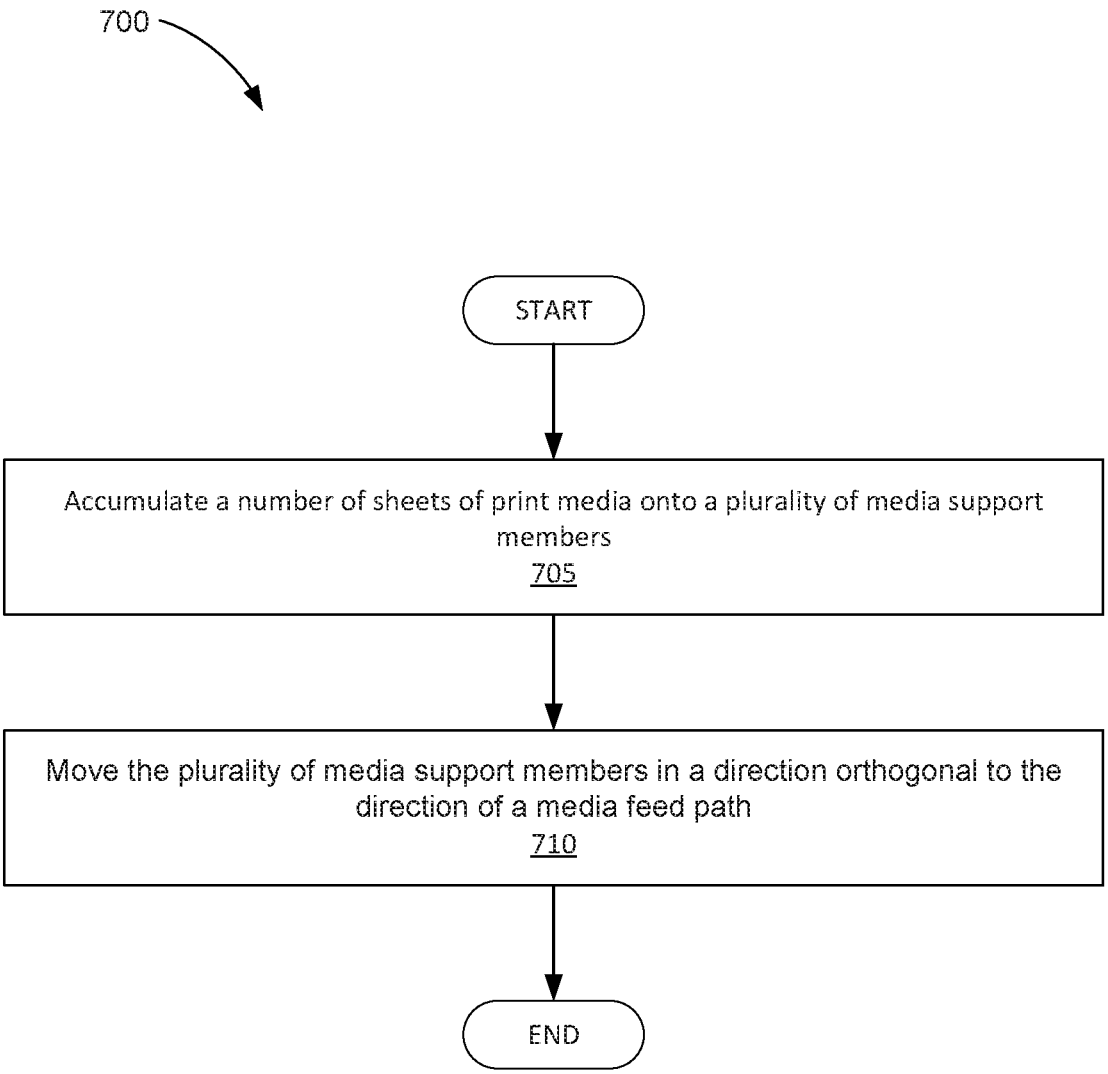
FIG. 8 is a flowchart depicting a method of finishing a number of sheets of print media according to an example of the principles described herein.

FIG. 8 is a flowchart depicting a method (700) of finishing a number of sheets of print media (FIG. 2, 110) according to one example of the principles described herein. The method (700) may begin by accumulating (705) a number of sheets of print media (FIG. 2, 110) onto a plurality of media support member (201-1, 201-2). As described above, the accumulation of the sheets of print media (FIG. 2, 110) may be accomplished through the controller (FIG. 1, 130) directing the media support members (201-1, 201-2) to be placed in a position sufficient to receive the print media (FIG. 2, 110) based on the orientation, size, and type of print media (110) being used for a print job. The controller (FIG. 1, 130) may further control the media transport mechanism (120) as described above to pull each sheet of print media (FIG. 2, 110) onto the media support members (201-1, 201-2).

Figure 2:
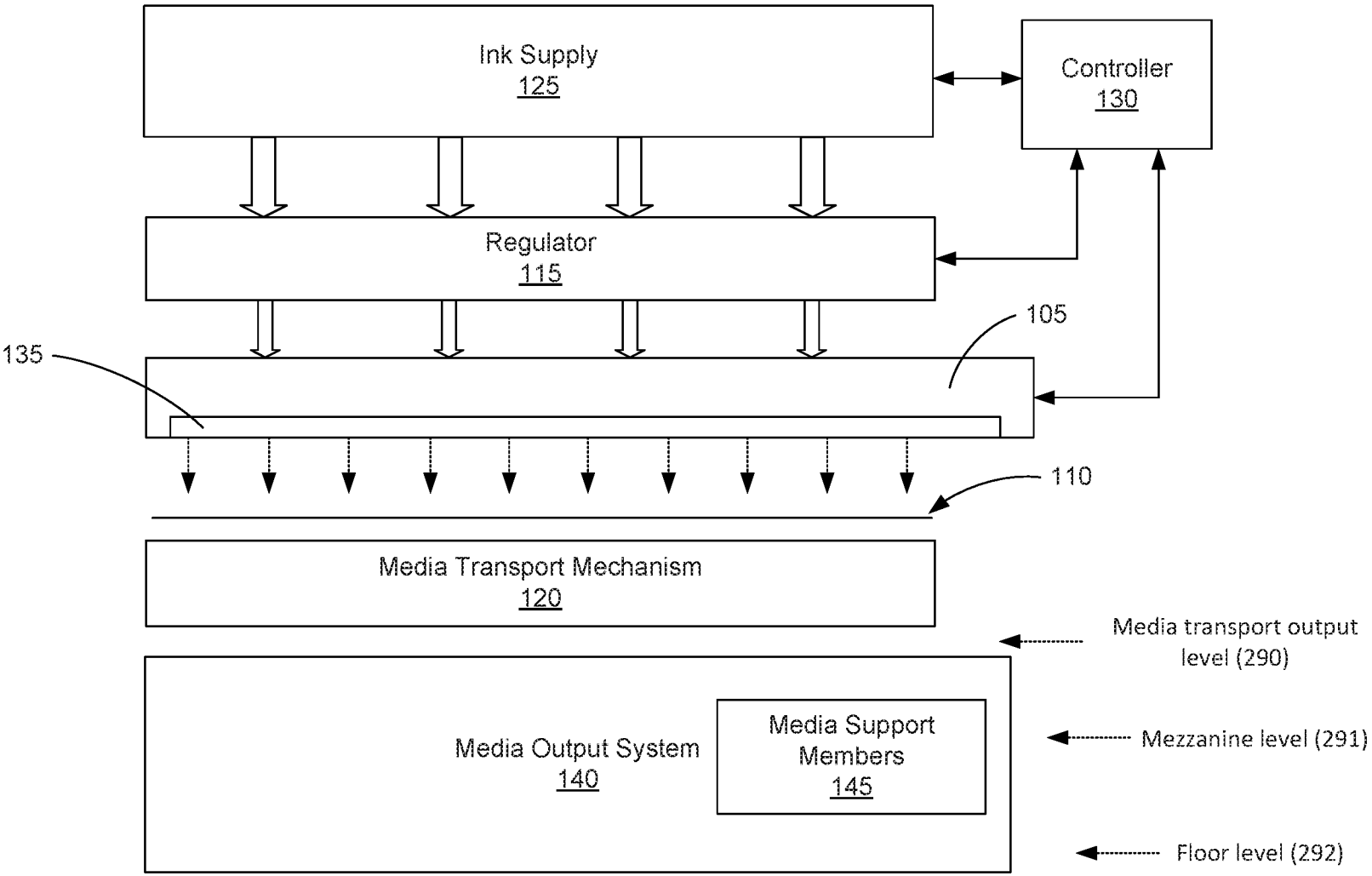
FIG. 2 is similar block diagram showing the media output, mezzanine and floor levels of the examples described herein.

The method (700) may continue with moving (710) the plurality of media support member (201-1, 201-2) in a direction orthogonal to the direction of a media feed path (FIG. 2, 203). As described above, the movement of the media support members (201-1, 201-2) may be accomplished by a number of motors controlled by the controller (FIG. 1, 130). The movement of the media support members (201-1, 201-2) may be based on whether or not the accumulated stack of print media (FIG. 2, 110) is to have a finishing process performed on the stack of print media (FIG. 2, 110). This is dictated by the information received by the controller (FIG. 1, 130).

As described above, the front media support member (201-1) of the plurality of media support members (201-1, 201-2) advances relatively faster than the rear media support member (201-2) of the plurality of media support members (201-1, 201-2). In one example, the acceleration of either of the front or rear media support member (201-2) may vary as the media support members (201-1, 201-2) advance along the front and rear gear racks (305, 306).

After the finishing processes have been completed, the media support members (201-1, 201-2) may move back to a home position as described above. The entire stack of print media (FIG. 2, 110) may then be dropped down to a floor level (FIG. 2, 292) of the output system (FIG. 2, 140) for an end user to retrieve. In one example the dropping process may include gripping the stack of print media (FIG. 2, 110) with a shelf and finger gripper (FIG. 3, 212). Once the stack of print media (FIG. 2, 110) has been secured by the shelf and finger gripper (FIG. 3, 212) the media support members (201-1, 201-2) may travel in opposite directions from each other along the front (305) and rear gear rack (306) allowing, at least initially, a trailing edge of the stack of print media (FIG. 2, 110) to fall down onto the floor below the mezzanine level. The leading edge of the stack of print media (FIG. 2, 110) may then be released from the shelf and finger gripper (FIG. 3, 212) and laid gently on the floor via the shelf. and finger gripper (FIG. 3, 212).

Aspects of the present system and method are described herein with reference to flowchart illustrations and/or block diagrams of methods, apparatus (systems) and computer program products according to examples of the principles described herein. Each block of the flowchart illustrations and block diagrams, and combinations of blocks in the flowchart illustrations and block diagrams, may be implemented by computer usable program code. The computer usable program code may be provided to a processor of a general purpose computer, the controller (FIG. 1, 130), special purpose computer, or other programmable data processing apparatus to produce a machine, such that the computer usable program code, when executed via, for example, the controller (FIG. 1, 130) or other programmable data processing apparatus, implement the functions or acts specified in the flowchart and/or block diagram block or blocks. In one example, the computer usable program code may be embodied within a computer readable storage medium; the computer readable storage medium being part of the computer program product. In one example, the computer readable storage medium is a non-transitory computer readable medium.

The media support members (201-1, 201-2) described herein allow each of the sheets of print media (FIG. 2, 110) originating from the output of an inkjet printing device to be accumulated and registered on a separate level within the output system (FIG. 2, 140). This also allows for a number of finishing processes to be conducted on a stack of print media (FIG. 2, 110) accumulated in an inkjet printing device (FIG. 1, 100) prior to delivery to the user. The separate accumulation level at the media support members (201-1, 201-2) minimizes the possibility that the quality and/or offset position of previous print jobs will be disturbed during the registration process of a new print job in the inject printing device (FIG. 1, 100). With the plurality of media support members (201-1, 201-2), print job registration may be maintained implementing the above descried differential speeds between the media support members (201-1, 201-2). The front gear rack (305) and rear gear rack (306) may be precisely aligned to provide for both an x- and y-registration of the individual sheets of print media (FIG. 2, 110) as the sheets of print media (FIG. 2, 110) as they rest on the media support members (201-1, 201-2). The media support member (201-1, 201-2) provide a complete and uniform support of the print job instead of allowing part of the sheet is supported on the floor of the output system (FIG. 2, 140) and the remaining portion of the job resting on a previously printed print job. The present output system (FIG. 2, 140) also eliminates the use of a secondary stack hold down mechanism to limit the previous print job's movement as the new print job is accumulated and is in contact with the top of the previous print job. Additionally, friction surfaces (FIG. 3, 208) on the media support members (201-1, 201-2) reduce any sliding between the media support members (201-1, 201-2) and the print media (FIG. 2, 110) improving job quality.

The preceding description has been presented to illustrate and describe examples of the principles described. This description is not intended to be exhaustive or to limit these principles to any precise form disclosed. Many modifications and variations are possible in light of the above teaching.

What is claimed is:

1. A printing device, comprising:

an inkjet print bar for printing on print media moving in a print media path;

a media output system comprising a mezzanine level, the mezzanine level comprising a plurality of media support members onto which print media is stacked, the mezzanine level being intermediate between a floor level of the media output system and a media output level of the print media path; and a motorized system for moving the media support members;

wherein the plurality of media support members move orthogonally relative to the print media path so that the stacked print media is transported to where a number of finishing processes may be performed on the stacked print media accumulated on the number of media support members; and wherein the motorized system comprises a gear and a wheel coupled to each media support member, the gear moving in a toothed track of a gear rack and the wheel moving on a portion the gear rack adjacent the toothed track as the media support member is moved.

2. The printing device of claim 1, further comprising a finishing device to perform a number of finishing processes on print media accumulated on the plurality of media support members.

3. The printing device of claim 1, wherein movement of the media support members orthogonally relative to a print media path further comprises moving a first media support member of the plurality of media support members relatively faster than a second media support member of the plurality of media support members.

4. The printing device of claim 1, wherein each of the plurality of media support members further comprise a number of extension bars extended out from each of the plurality of media support members by a number of extension arms.

5. The printing device of claim 1, further comprising a number of registration walls to align the print media in a direction parallel to the print media path.

6. The printing device of claim 1, wherein at least one of the plurality of media support members comprises a number of surfaces that impart a relatively higher coefficient of friction to a sheet of print media than other surface portions of the at least one media support member.

7. A method for finishing a number of sheets of print media, comprising:

accumulating a number of sheets of print media stacked onto and supported on a plurality of media support members within a media output system; and moving the stack of print media with the plurality of media support members in a direction orthogonal to the direction of a media feed path;

wherein a first media support member of the plurality of media support members advances relatively faster than a second media support member of the plurality of media support members;

wherein moving the plurality of media support members in a direction orthogonal to the direction of the media feed path comprises moving the plurality of media support members from a starting position towards a finishing device and returning the plurality of media support members to the starting position after the finishing device conducts a finishing process; and wherein returning the plurality of media support members to the starting position further comprises advancing the first media support member relatively slower than the second media support member.

8. The method of claim 7, wherein advancement of the plurality of media support members in a direction orthogonal to the direction of the media feed path which places the accumulated sheets of print media in contact with a finishing device.

9. The method of claim 8, wherein the finishing device comprises a stapler, a hole puncher, an embosser, binder, or combinations thereof.

10. A media output system, comprising:

a plurality of media support members to receive a number of sheets of print media from a printing device; and a print finishing device to conduct finishing processes on the number of sheets of print media;

a motorized system for moving the media support members;

wherein the plurality of media support members transport the number of sheets of print media towards the finishing device with each of the plurality of media support members moving at different speeds relative to each other such that the sheets of print media extend beyond a media support member that is closest to the finishing device in a direction of the finishing device and wherein at least one of the plurality of media support members comprises at least one friction surface that imposes a higher coefficient of friction to one of the number of sheets of print media than other surface portions of the at least one media support member.

11. The media output system of claim 10, wherein the plurality of media support members are intermediate to an output of the printing device and a floor of the media output system.

12. The printing device of claim 1, the media output system further comprising a shelf and finger gripper to grip the stacked print media when the stack of print media is dropped from the mezzanine level to the floor level.

13. The printing device of claim 1, wherein each media support member comprise a first portion on which the wheel and gear are mounted, the first portion being at a right angle to a second portion on which the stack of print media is supported.

14. The printing device of claim 1, wherein each media support member has a second wheel coupled thereto.

15. The method of claim 7, further comprising dropping the stack of print media from a mezzanine level of the plurality of media support members to a floor level by removing support of the media support members under the stack of print media after the finishing process.

16. The method of claim 7, wherein the stack of print media extends beyond the second media support member in a direction toward a finishing device located laterally beside the media feed path, the second media support member being closer to the finishing device than the first media support member.

17. The media output system of claim 10, further comprising a shelf and finger gripper to grip the sheets of print media when the sheets of print media are dropped from a mezzanine level of the media support members to a floor level.

18. The method of claim 7, further comprising, after operation of the finishing device, dropping the sheets of print media from a mezzanine level of the media support members to a floor level.

* * * * *